US007602114B2

(12) United States Patent
Fu et al.

(10) Patent No.: US 7,602,114 B2
(45) Date of Patent: Oct. 13, 2009

(54) FIELD EMISSION FLAT LAMP WITH STRIP CATHODE STRUCTURE AND STRIP GATE STRUCTURE IN THE SAME PLANE

(75) Inventors: Chuan-Hsu Fu, Miaoli County (TW); Biing-Nan Lin, Taichung (TW); Wei-Yi Lin, Yunlin County (TW); Ming-Hung Lin, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/309,008

(22) Filed: Jun. 8, 2006

(65) Prior Publication Data

US 2007/0164651 A1 Jul. 19, 2007

(30) Foreign Application Priority Data

Jan. 18, 2006 (TW) ..... 95101885 A

(51) Int. Cl.
*H01J 63/04* (2006.01)

(52) U.S. Cl. ..... 313/491; 313/495

(58) Field of Classification Search ..... 313/491, 313/495–497

See application file for complete search history.

(56) References Cited

U.S. PATENT DOCUMENTS 5,185,554 A * 2/1993 Nomura et al. ..... 313/495
5,256,936 A * 10/1993 Itoh et al. ..... 313/495
5,359,256 A * 10/1994 Gray ..... 313/169
5,633,650 A * 5/1997 Kishino et al. ..... 345/75.2
5,637,023 A * 6/1997 Itoh et al. ..... 445/24
5,652,083 A * 7/1997 Kumar et al. ..... 430/315
5,982,091 A * 11/1999 Konishi ..... 313/495
6,946,800 B2 * 9/2005 Takeuchi et al. ..... 315/169.3
2003/0006684 A1 * 1/2003 Kawate et al. ..... 313/311
2003/0122467 A1 * 7/2003 Cho et al. ..... 313/309
2004/0130258 A1 * 7/2004 Oh ..... 313/495
2004/0140756 A1 * 7/2004 Kang et al. ..... 313/497
2004/0222734 A1 * 11/2004 Oh ..... 313/497
2005/0152155 A1 * 7/2005 Kang et al. ..... 362/558
2005/0184644 A1 * 8/2005 Moon ..... 313/497
2005/0184645 A1 * 8/2005 Ryu ..... 313/497
2005/0258730 A1 * 11/2005 Lee et al. ..... 313/310

* cited by examiner

*Primary Examiner*—Toan Ton
*Assistant Examiner*—Hana A Sanei
(74) *Attorney, Agent, or Firm*—Jianq Chyun IP Office

(57) ABSTRACT

A cathode plate including a substrate, a cathode structure, a gate structure and emission sources is provided. The cathode structure and the gate structure are disposed on the substrate. The emission sources are arranged regularly on the cathode structure. A field emission flat lamp including said cathode plate, an anode plate and a sealant is provided. The sealant is disposed between and seals the cathode plate and the anode plate. Since the volume of each emission source is small, the bubbles resided inside the emission sources can be reduced, such that the qualities of the field emission flat lamp and the cathode plate thereof can be improved.

15 Claims, 6 Drawing Sheets

FIELD EMISSION FLAT LAMP WITH STRIP CATHODE STRUCTURE AND STRIP GATE STRUCTURE IN THE SAME PLANE

CROSS-REFERENCE TO RELATED APPLICATION

This application claims the priority benefit of Taiwan application serial no. 95101885, filed on Jan. 18, 2006. All disclosure of the Taiwan application is incorporated herein by reference.

BACKGROUND OF THE INVENTION

1. Field of Invention

The present invention relates to a flat lamp and cathode plate thereof. More particularly, the present invention relates to a field emission flat lamp and cathode plate thereof.

2. Description of Related Art

The luminescence principle of the field emission display is to absorb electrons in the top end of materials by utilizing the electric field in a vacuum environment, and the field emission electrons from the cathode plate accelerate to be absorbed and bombard to the fluorescent powder of the anode due to the positive voltage over the anode, thus the luminescence occurs. The cathode plate is used as the field electron emission source, and the anode plate is used as the light-emitting source. The luminescence occurs with the electrons emitted from the cathode plate bombarding to the fluorescent layer of the anode plate. When the field emission display is used as the backlight source of other elements, it is a flat luminous element with a more preferred light uniformity compared with the cold cathode fluorescent lamp (CCFL) or the light emitting diode (LED).

FIG. 1 is a top view of a cathode plate of a well-known field emission flat lamp. Please refer to FIG. 1, on the well-known cathode plate 100 of the field emission flat lamp (not shown), gate structures 110 and cathode structures 120 are arranged interlacedly in parallel. The emission layer 130 is mixed to starchiness first, and disposed in strip-form on the cathode structures 120 by screen printing. However, bubbles may reside inside the starched emission layer 130, i.e. there are tiny bubbles in the emission layer 130. Furthermore, because the emission layers 130 are arranged in strip-form on the cathode structures 120, the accumulation of the large amount of the emission layers 130 makes removing the bubbles even more difficult. If the bubbles can not be removed, the field-emission electric field distribution will be un-uniform during the luminescence of the field emission flat lamp, such that the light uniformity of the field emission flat lamp is poor. Similarly, the gate structures 110 and cathode structures 120 are also made of starched form before screen printing, which leads to the problem of bubble occurrence and removal difficulty.

Since the light source uniformity required by the current displays is of an extremely high standard, if the conventional field emission flat lamp is to be used as a light source for displays, a diffusion film is required to improve the light uniformity, which will increase the assembling complexity of displays and further increase the cost of raw materials and the assembling process. Thus, the conventional field emission flat lamp is not suitable for being widely applied in the market.

SUMMARY OF THE INVENTION

Accordingly, the present invention is directed to provide a cathode plate that is suitable to reduce residual bubbles.

Accordingly, the present invention is also directed to provide a field emission flat lamp that has advantage of luminescence uniformity.

Accordingly, the present invention provides a cathode plate including a substrate, a cathode structure, a gate structure and a plurality of emission sources. The cathode structure and the gate structure are disposed on the substrate. The emission sources are arranged regularly and separately on or within the cathode structure. The cathode structure is in strip structure without branch. The gate structure is adjacent to the cathode structure. The gate structure is in strip structure. The cathode structure and the entire gate structure are formed in a same plane.

Accordingly, the present invention is also directed to provide a field emission flat lamp including a cathode plate, an anode plate and a sealant. The cathode plate includes a first substrate, a cathode structure, a gate structure and a plurality of emission sources. The cathode structure and the gate structure are disposed on the first substrate. The emission sources are arranged regularly and separately on or within the cathode structure. The cathode structure is in strip structure without branch. The gate structure is adjacent to the cathode structure. The gate structure is in strip structure. The cathode structure and the entire gate structure are formed in a same plane. The sealant is disposed between and seals the cathode plate and the anode plate.

In an embodiment of said field emission flat lamp and cathode plate, the cathode structure has a plurality of grooves and the emission sources are disposed in the grooves. Moreover, the grooves, for example, expose the substrate, and the emission sources are in touch with the substrate.

In an embodiment of said field emission flat lamp and cathode plate, the cathode plate contains plural cathode structures and gate structures. In them, the cathode structures are in strip structure and arranged in parallel one another; the gate structures are in strip structure and interlacedly in parallel with the cathode structures. The emission sources are arranged in rows along with the extension direction of the cathode structures. Moreover, the emission sources on adjacent cathode structures can be arranged justified or crisscross each other.

In an embodiment of said field emission flat lamp, the anode plate includes a second substrate, an anode layer and a fluorescent layer. The anode layer is disposed on the surface of the second substrate that faces the cathode plate, and the fluorescent layer is disposed on the anode layer.

In summary, in the field mission flat lamp and cathode plate thereof of the present invention, since the volume of each emission source is small, the bubbles resided in the emission sources can be reduced, and the gate structures and the cathode structures with grooves are also small that the residual bubbles can be reduced, such that the quality of the cathode plate can be improved and luminescence uniformity of the field emission flat lamp is increased.

In order to make the aforementioned and other objects, features and advantages of the present invention comprehensible, a preferred embodiment accompanied with figures is described in detail below.

DESCRIPTION OF EMBODIMENTS

Figure 1:
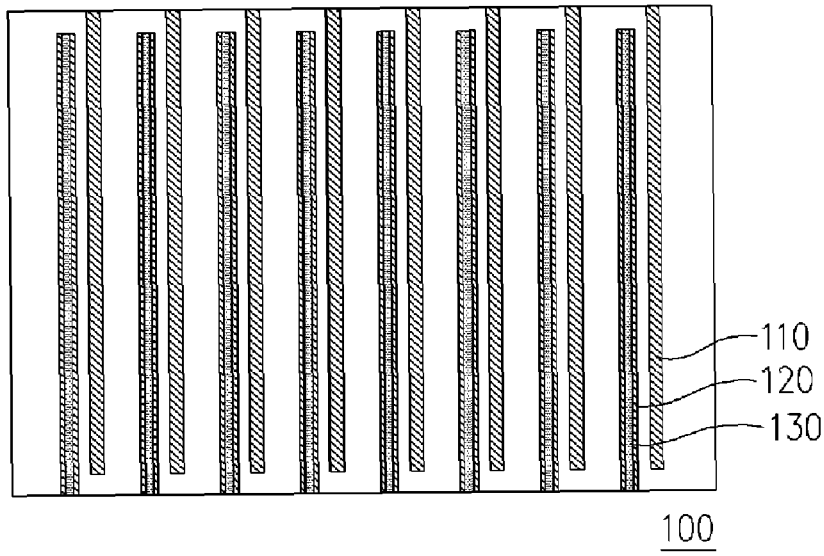
FIG. 1 (PRIOR ART)
FIG. 1 is a top view of a cathode plate of a well-known field emission flat lamp.
Figure 2:
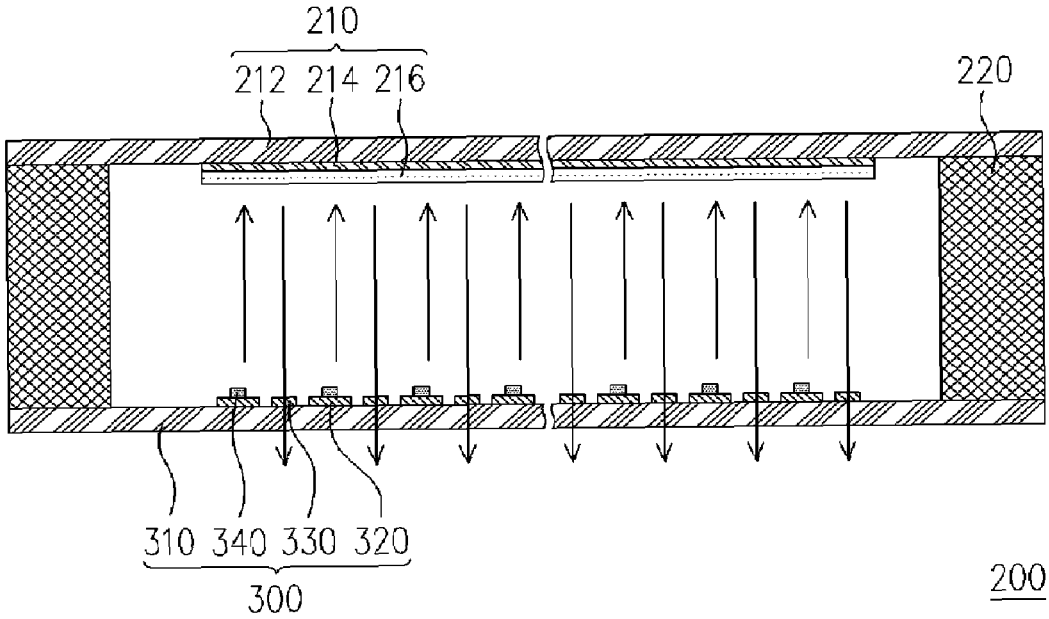
FIG. 2 is a cross-sectional view of a field emission flat lamp of an embodiment of the present invention.
Figure 3:
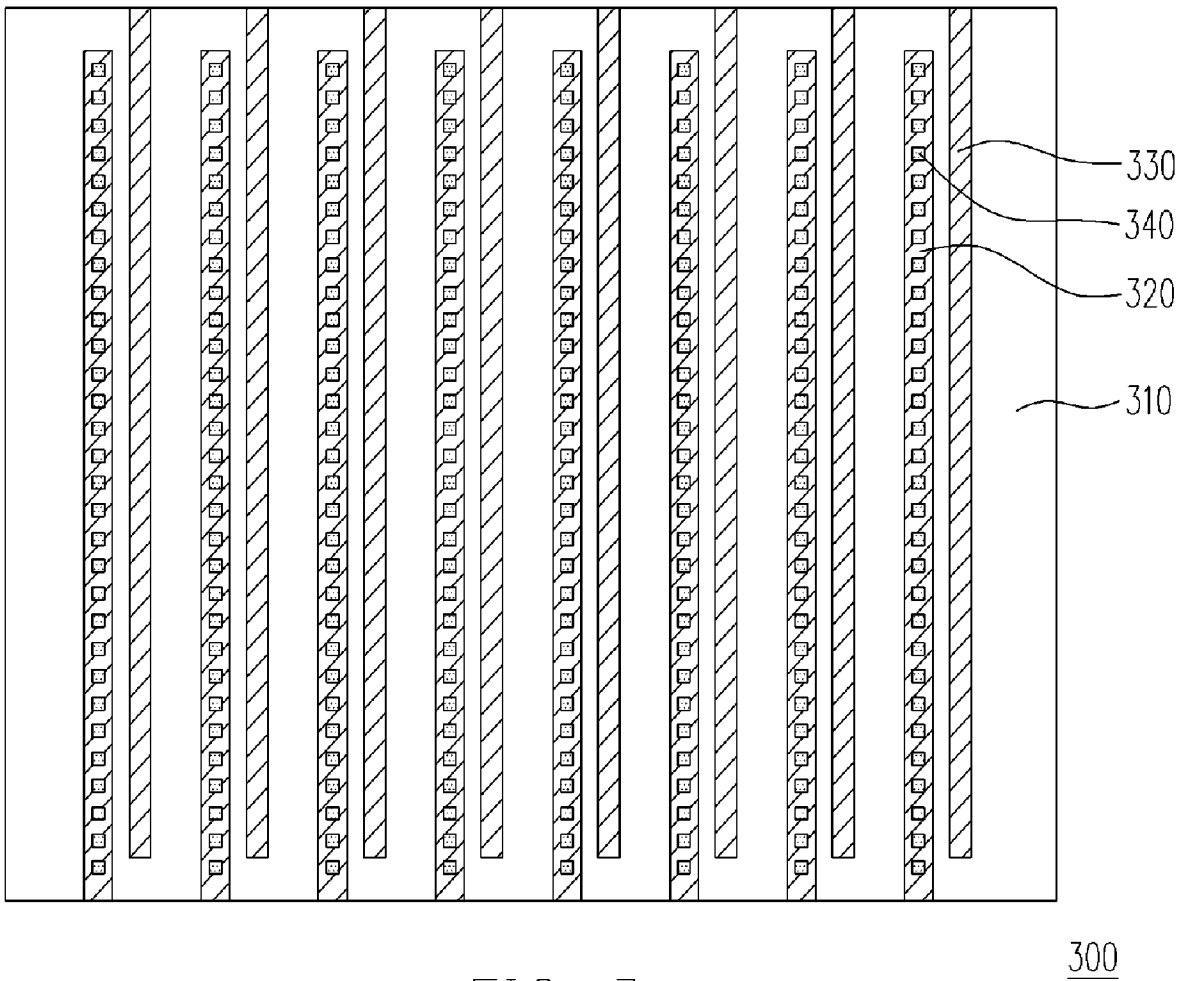
FIG. 3 is a top view of the cathode plate in FIG. 2.

FIG. 2 is a cross-sectional view of the field emission flat lamp of an embodiment of the present invention, and FIG. 3 is a top view of the cathode plate in FIG. 2. Please refer to FIG. 2 and FIG. 3. The field emission flat lamp 200 of the embodiment includes a cathode plate 300, an anode plate 210 and a sealant 220. The sealant 220 is disposed between and seals the anode plate 210 and the cathode plate 300. For instance, the sealant 220 can be silicon-glue or other suitable materials. In addition, as a support, the sealant keeps a suitable gap between the anode plate 210 and the cathode plate 300. Moreover, a support can be disposed or made between the anode plate 210 and the cathode plate 300 to keep a suitable gap.

Please refer to FIG. 2 and FIG. 3. The cathode plate 300 of the embodiment includes a substrate 310, at least one cathode structure 320 (here, more than one is exemplified), at least one gate structure 330 (here, more than one is used as an example) and a plurality of emission sources 340. In the embodiment, the emission sources are spot-formed, but it is not restricted in the present invention. The cathode structures 320 and the gate structures 330 are disposed on the substrate 310, and both of them are in strip structure. Wherein, the gate structures 330 and the cathode structures 320 are arranged in parallel and interlaced with each other. The emission sources 340 are arranged on the cathode structures regularly. As mentioned, since the volume of each of the emission sources 340 is smaller than that in the well-known techniques, the bubbles resided inside the emission sources 340 can be reduced greatly. Such that, distribution of field emission electric field of the field emission flat lamp 200 will be more uniform, and luminescence uniformity of the field emission flat lamp is increased.

Please refer to FIG. 2, in the embodiment; the anode plate 210 includes a substrate 212, an anode layer 214 and a fluorescent layer 216. The anode layer 214 is disposed on the surface of the substrate 212 that faces the cathode plate 300, and the fluorescent layer 216 is disposed on the anode layer 214. Particularly, the anode layer 214 and the fluorescent layer 216 are disposed between the substrate 212 and the cathode plate 300. In addition, the anode layer 214 can be able to reflect light.

When the field emission flat lamp 200 is used as a back light source for a display (not shown), the cathode plate 300 is used as a light emission side, facing the display panel (not shown). Therefore, the heat caused by electrons hitting on fluorescent powder on the anode plate 210 that affects the liquid crystal display panel can be avoided. When the field emission flat lamp 200 is disposed as described, the substrate 212 can be made of transparent or opaque materials and the anode layer 214 can be made of the materials with high reflectance and conductivity like silver, aluminum etc. to improve light usage. In addition, since the reflective light needs to pass through the cathode plate 300, it is better that the substrate 310 is made of transparent materials, and the cathode structures 320 and the gate structures 330 are arranged in parallel to improve the rate of light pass-through. However, when the filed emission flat lamp is not configured in the display as mentioned above, the materials, either transparent or opaque, of the substrates 212 and 310 can be modified.

If the application mode of the cathode plate 300 is not restricted, the material of the substrate 310 can be transparent, like glass, or opaque; the material of the cathode structures 320 and the gate structures 330 can be conductive, like silver or other suitable metals, or metalloids. The emission source 340 is made of, for example, Carbon Nanotube (CNT) or other materials that is suitable for field electron emission. Wherein, CNT can be formed by arc evaporation, laser ablation of graphite or Chemical Vapor Deposition mode.

Figure 4:
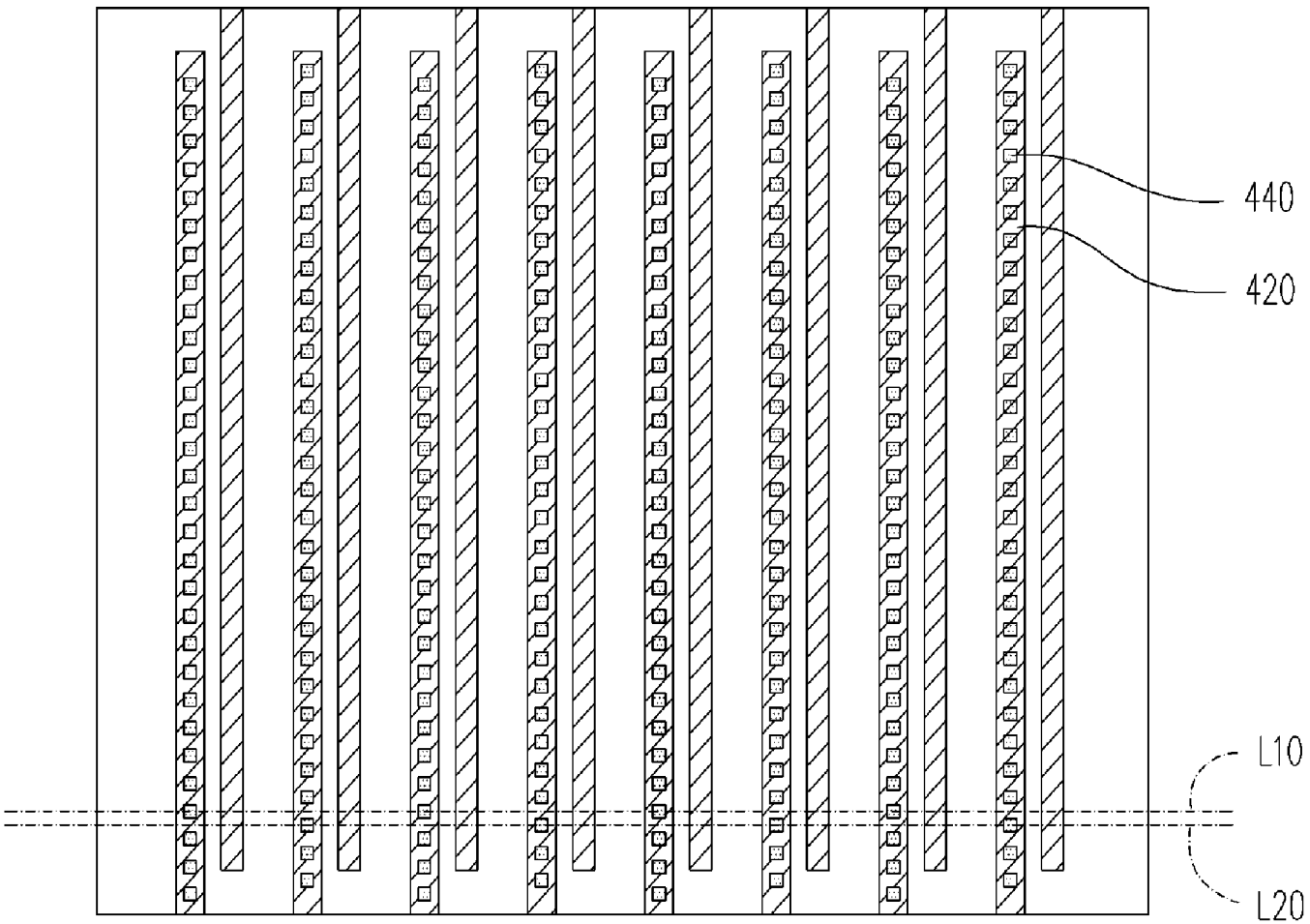
FIG. 4 is a top view of the cathode plate of another embodiment of the present invention.

FIG. 4 is a top view of the cathode plate of another embodiment of the present invention. Please refer to FIGS. 3 and 4, the emission sources 340 and 440 are arranged in rows following the extension direction of the cathode structures 320 and 420, respectively. However, it is not necessary to arrange each of the emission sources 340 and 440 on the cathode structures 320 and 420 in one line, meanwhile, it is not necessary to arrange the emission sources 340 and 440 on one of the cathode structures 320 and 420 in one line. In addition, the emission sources 340 on adjacent cathode structures 320 could be arranged justified each other as shown in FIG. 3. Alternatively, the emission sources 440 on adjacent cathode structures 420 could be arranged crisscross each other. Using FIG. 4 as an example, the emission sources 440 on two of adjacent cathode structures 420 are justified with two lines L10 and L20, respectively. Those familiar with this technology can easily understand the arrangement by referring to what has described. In the present invention, there are a lot of other variable ways of arranging the emission sources, as long as the emission sources are arranged regularly on the cathode structures.

Figure 5:
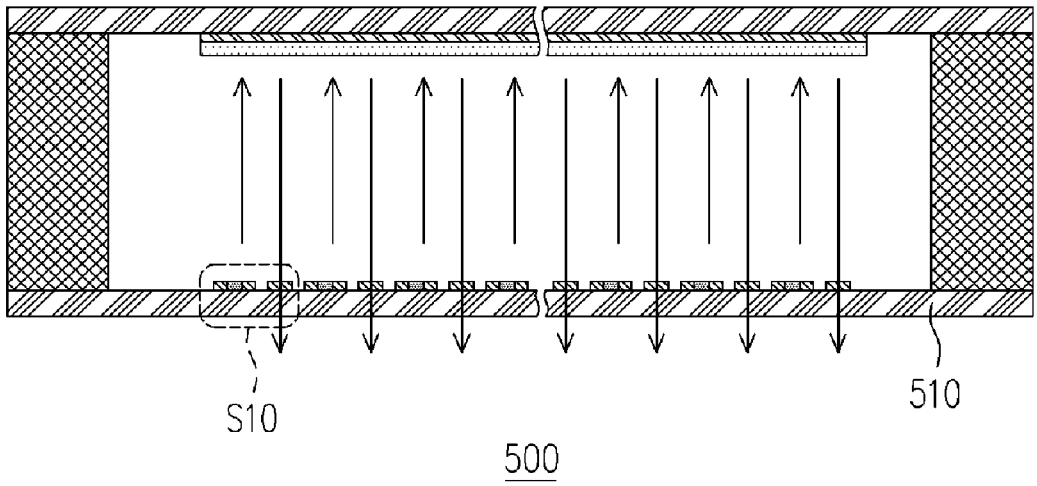
FIG. 5 is a cross-sectional view of the field emission flat lamp of another embodiment of the present invention.
Figure 6:
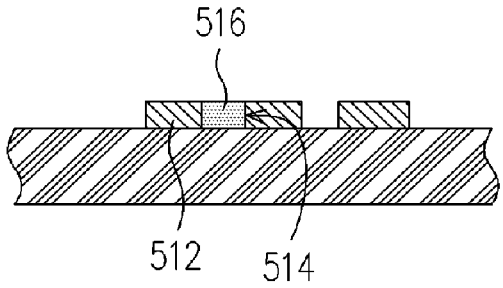
FIG. 6 is a local enlargement view of area S10 in FIG. 5.

FIG. 5 is a cross-sectional view of the field emission flat lamp of another embodiment of the present invention. FIG. 6 is a local enlargement view of area S10 in FIG. 5. Please refer to FIG. 5 and FIG. 6. The field emission flat lamp 500 of the embodiment is similar with the field emission flat lamp 200 in FIG. 2. In them, the same parts are omitted. The difference is: the cathode structure 512 of the cathode plate 510 has grooves 514, and the emission source 516 is in the grooves 514. The grooves 514, for example, expose the substrate 510, i.e. the emission source 516 in the groove 514 is in touch with the substrate 510. Wherein, the grooves 514 on the cathode structures 512 help position the emission source 516 accurately. When the cathode plate 510 is used in the field emission flat lamp 500, since distance between each of the emission sources 516 is controlled accurately, the electric filed of field emission can distribute uniformly, and the luminescence uniformity of the field emission flat lamp 500 is accordingly increased. In addition, the arrangement of the grooves 514 can be modified as the emission sources 340 and 440 shown in FIG. 3 and FIG. 4; nonetheless, the present invention does not intend to limit the arrangement, as long as they are arranged regularly on the cathode structures 512.

Figure 7:
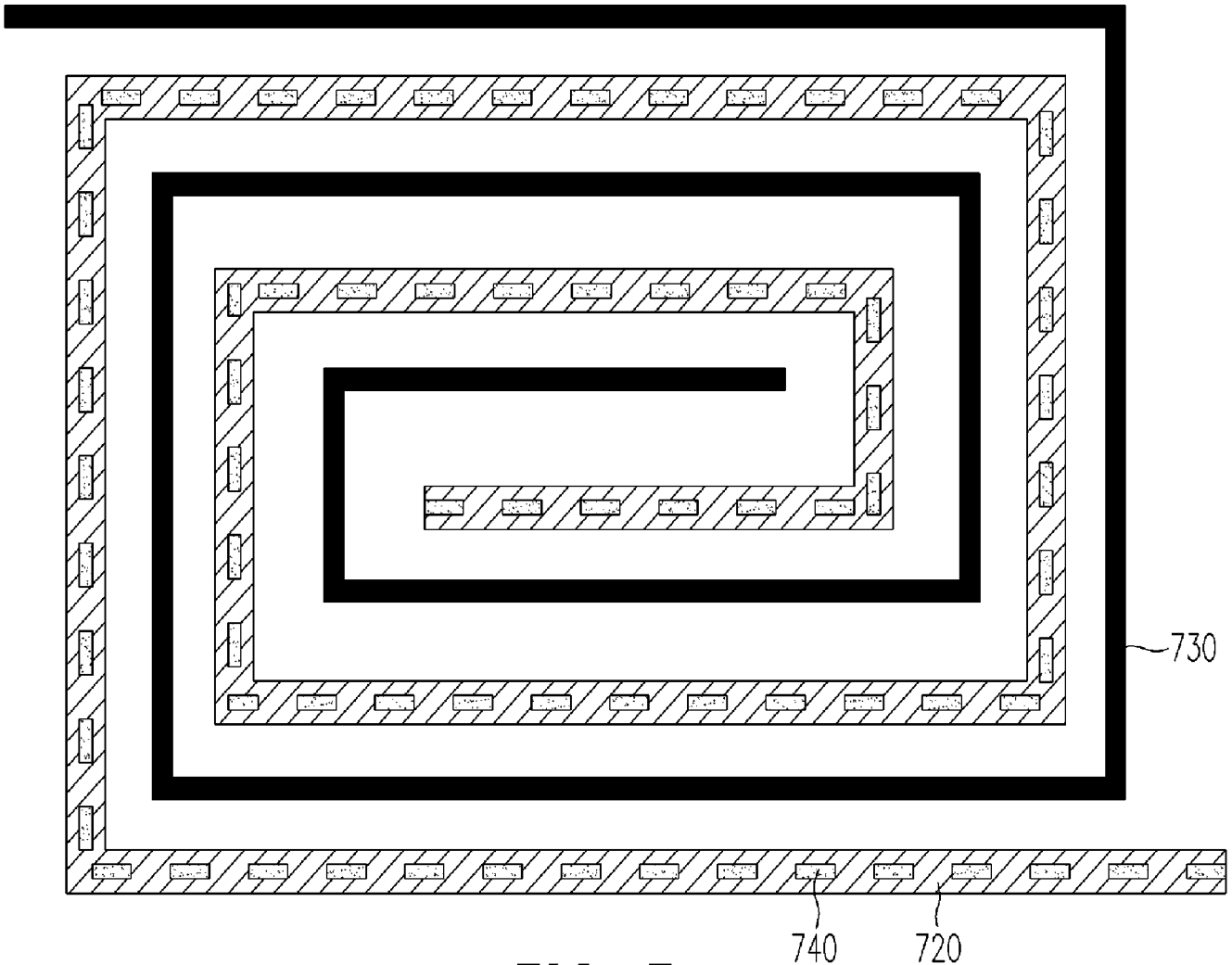
FIG. 7 and FIG. 8 are top views of the cathode plate of two other embodiments of the present invention.
Figure 8:
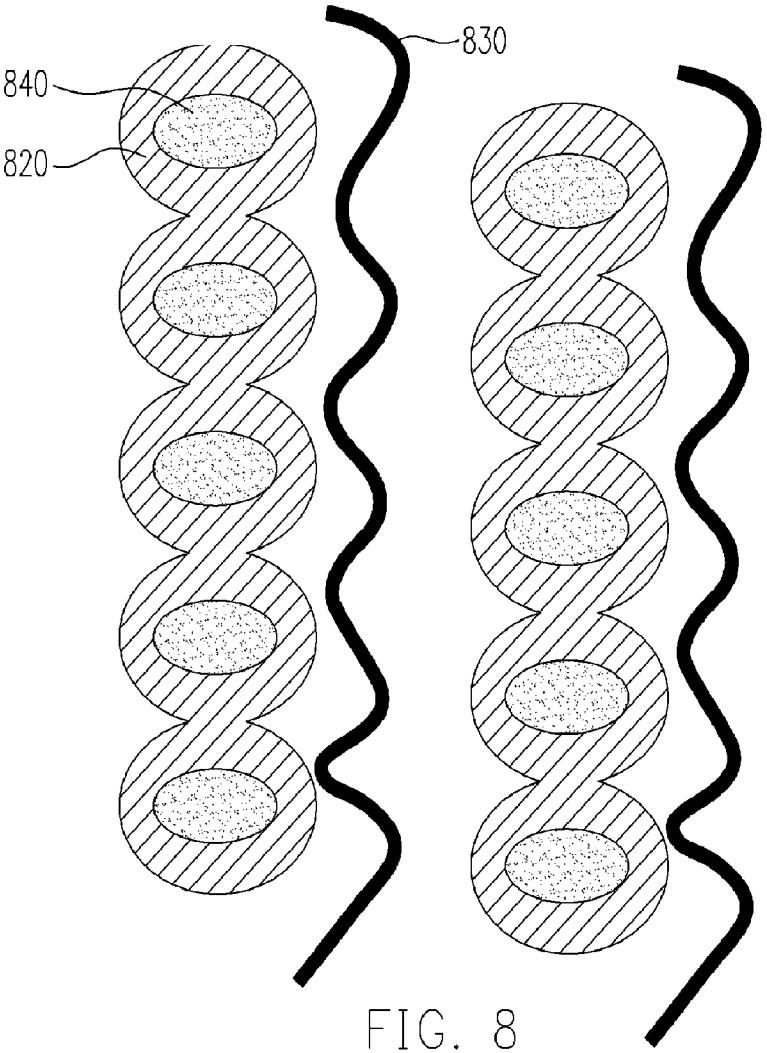

FIGS. 7 and 8 are the other two top views of the embodiments of the present invention, in that, the substrate is not drawn. Compared with the previous embodiments, similar parts are omitted. Please refer to FIG. 7, only one cathode structure 720 and one gate structure 730 are in the embodiment; the emission source 740 is in strip-shape; a plurality of emission sources 740 are on the cathode structure 720. Then please refer to the FIG. 8, in the embodiment, shape of the cathode structure 820 and the gate structure 830 are different with the embodiment in FIG. 3, but there are plural emission sources 840 on the cathode structure 820. The shape of the cathode structure and the gate structure are not limited in the present invention.

As described, in the field emission flat lamp and cathode plate thereof of the present invention, the present invention mainly uses emission sources, and the volume of each emission source is small. The bubbles resided inside the emission sources can be reduced. In addition, the total amount of the emission materials is also reduced. Accordingly, not only the possibility of residual bubble occurrence is reduced, but also the whole cost is lowered; besides, the quality of the field emission flat lamp and the cathode plate thereof is improved, and the luminescence uniformity of the field emission flat lamp is increased. In addition, when using the gate structure and the cathode structure with grooves created by screen print mode, the bubbles resided can be reduced, the total cost can be lowered, and the quality of the field emission flat lamp and the cathode plate can be improved as well. Furthermore, in a field emission flat lamp with good luminescence uniformity, the diffusion film is not required any longer to improve luminescence uniformity. Thus, the present invention reduces the complication of display assembly and the cost of materials and assembly. In conclusion, the field emission flat lamp of the present invention can be widely utilized in the market.

Although the present invention has been apparent as the preferred embodiments, it is not limited to the present invention. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cathode plate includes:

a cathode structure, disposed on a substrate, the cathode structure is in strip structure without branch and has a plurality of emission sources arranged regularly and separately thereon or therewithin; and a gate structure, disposed on the substrate, adjacent to the cathode structure, the gate structure is in strip structure, wherein the cathode structure and the entire gate structure are formed in a same plane.

2. The cathode plate as claimed in claim 1, wherein the cathode structure has a plurality of grooves, and the emission sources are disposed in the grooves.

3. The cathode plate as claimed in claim 2, wherein the grooves expose the substrate, and the emission sources are in touch with the substrate.

4. The cathode plate as claimed in claim 1 includes a plurality of cathode structures and a plurality of gate structures, wherein, the cathode structures are in strip structure and arranged in parallel with each other; the gate structures are in strip structure and arranged interlacedly in parallel with the cathode structures.

5. The cathode plate as claimed in claim 4, wherein, each of the cathode structures has a plurality of grooves arranged in row along with the extension direction of each of the cathode structures, and the emission sources are disposed in the grooves.

6. The cathode plate as claimed in claim 5, wherein, the grooves on adjacent cathode structures are arranged justified.

7. The cathode plate as claimed in claim 5, wherein, the grooves on adjacent cathode structures are arranged crisscrossed each other.

8. A field emission flat lamp includes:

a cathode plate includes:

a first substrate;

a cathode structure, disposed on the first substrate, the cathode structure is in strip structure without branch and has a plurality of emission sources arranged regularly and separately thereon or therewithin;

a gate structure, disposed on the first substrate, adjacent to the cathode structure, the gate structure is in strip structure, wherein the cathode structure and the entire gate structure are formed in a same plane;

an anode plate, disposed above the cathode plate; and a sealant, disposed and seals between the cathode plate and the anode plate.

9. The field emission flat lamp as claimed in claim 8, wherein, the cathode structure has a plurality of grooves, and the emission sources are disposed in the grooves.

10. The field emission flat lamp as claim in claim 9, wherein the grooves expose the first substrate, and the emission sources are in touch with the first substrate.

11. The field emission flat lamp as claimed in claim 8 includes a plurality of cathode structures and a plurality of gate structures, wherein, the cathode structures are in strip structure and arranged parallel with each other; the gate structures are in strip structure and arranged interlacedly in parallel with the cathode structures.

12. The field emission flat lamp as claimed in claim 11, wherein each of the cathode structures has a plurality of grooves arranged in row along with the extension direction of each of the cathode structures, and the emission sources are disposed in the grooves.

13. The field emission flat lamp as claimed in claim 12, wherein, the grooves on adjacent cathode structures are arranged justified.

14. The field emission flat lamp as claimed in claim 12, wherein, the grooves on adjacent cathode structures are arranged crisscrossed each other.

15. The field emission flat lamp as claimed in claim 8, wherein the anode plate includes:

a second substrate;

an anode layer, disposed on the surface of the second substrate facing the cathode plate; and a fluorescent layer, disposed on the anode layer.

* * * * *